US007470849B2

(12) United States Patent
Saado et al.

(10) Patent No.: US 7,470,849 B2
(45) Date of Patent: Dec. 30, 2008

(54) WAVEFORM GENERATION FOR FM SYNTHESIS

(75) Inventors: Alon Saado, San Diego, CA (US); Kathy Lieberman, San Diego, CA (US); Victor Manzella, San Diego, CA (US)

(73) Assignee: VIA Telecom Co., Ltd. (KY)

( * ) Notice: Subject to any disclaimer, the term of this patent is extended or adjusted under 35 U.S.C. 154(b) by 58 days.

(21) Appl. No.: 11/543,339

(22) Filed: Oct. 4, 2006

(65) Prior Publication Data

US 2007/0079689 A1 Apr. 12, 2007

Related U.S. Application Data

(60) Provisional application No. 60/723,343, filed on Oct. 4, 2005.

(51) Int. Cl.
*G10H 7/00* (2006.01)

(52) U.S. Cl. ..... 84/604; 84/624

(58) Field of Classification Search ..... 84/604, 84/624

See application file for complete search history.

(56) References Cited

U.S. PATENT DOCUMENTS

| | | | | |
|---|---|---|---|---|
| 4,440,058 | A * | 4/1984 | Bass et al. | 84/607 |
| 4,810,977 | A * | 3/1989 | Flugstad et al. | 332/127 |
| 5,541,354 | A * | 7/1996 | Farrett et al. | 84/603 |
| 5,619,535 | A | 4/1997 | Alvarez, Jr. | 375/308 |
| 5,969,703 | A * | 10/1999 | Surguy | 345/97 |
| 6,373,316 | B1 * | 4/2002 | Wu | 327/356 |
| 6,621,426 | B1 * | 9/2003 | van Nguyen | 341/50 |
| 2002/0046639 | A1 * | 4/2002 | Kikumoto | 84/604 |
| 2003/0014082 | A1 * | 1/2003 | Schu et al. | 607/5 |
| 2004/0184559 | A1 * | 9/2004 | Ballantyne | 375/300 |

FOREIGN PATENT DOCUMENTS

WO WO2004/095731 * 11/2004

* cited by examiner

*Primary Examiner*—Jeffrey Donels
*Assistant Examiner*—Kawing Chan
(74) *Attorney, Agent, or Firm*—K & L Gates LLP

(57) ABSTRACT

A method and system is disclosed for generating one or more predetermined waveforms from one or more contiguous segments of at least one prototype waveform stored in one or more memory tables, the method and system comprising iterations of following sample processing steps: reading at least one sample of the stored prototype waveform at a predetermined address, modifying the sample according to a predetermined logic, and accumulating the modified sample, wherein through a predetermined number of iterations of above steps, a cycle of a new waveform is formed by the accumulated modified samples.

21 Claims, 12 Drawing Sheets

(a)

(b)

| | Seg1 | Seg2 | Seg3 | Seg4 |
|---|---|---|---|---|
| Seg Mod | 1 | -1 | 1 | -1 |
| Offset Sum | 0 | 1 | 0 | 1 |
| Offset Addr | 0 | $-(2^M/2-1)$ | 0 | $-(2^M/2-1)$ |

SFT_RIGHT= 0

(c)

| | Seg1 | Seg2 | Seg3 | Seg4 |
|---|---|---|---|---|
| Seg Mod | 1 | -1 | 1 | -1 |
| Offset Sum | 0 | 1 | -1 | 0 |
| Offset Addr | 0 | $-(2^M/2-1)$ | $+(2^M/2-1)$ | 0 |

SFT_RIGHT= 0

(d)

| | Seg1 | Seg2 | Seg3 | Seg4 |
|---|---|---|---|---|
| Seg Mod | -1 | 1 | -1 | 1 |
| Offset Sum | 1 | -1 | 1 | -1 |
| Offset Addr | $+(2^M/2-1)$ | $-(2^M/2-1)$ | $+(2^M/2-1)$ | $-(2^M/2-1)$ |

SFT_RIGHT= 0

(e)

K=2

(a)

(b)

| | Seg1 | Seg2 | Seg3 | Seg4 |
|---|---|---|---|---|
| Seg Mod | 0 | 0 | 1 | 1 |
| Offset Sum | 0 | 0 | 0 | 0 |
| Offset Addr | 0 | 0 | $+(2^M/2-1)$ | $+(2^M/2-1)$ |

SFT_RIGHT= -10

(c)

(a)

(b)

| | Seg1 | Seg2 | Seg3 | Seg4 | Seg5 | Seg6 | Seg7 | Seg8 |
|---|---|---|---|---|---|---|---|---|
| Seg Mod | 1 | -1 | -1 | 1 | -1 | 1 | 1 | -1 |
| Offset Sum | 0 | 1+Seg1LastVal | 1+Seg1LastVal | 0 | 0 | -1+Seg5LastVal | -1+Seg5LastVal | 0 |
| Offset Addr | 0 | 0 | 0 | 0 | 0 | 0 | 0 | 0 |

SFT_RIGHT= 0

(c)

| | Seg1 | Seg2 | Seg3 | Seg4 | Seg5 | Seg6 | Seg7 | Seg8 |
|---|---|---|---|---|---|---|---|---|
| Seg Mod | 1 | -1 | 1 | -1 | 1 | -1 | 1 | -1 |
| Offset Sum | 0 | Seg1LastVal | 0 | Seg3LastVal | 0 | Seg5LastVal | 0 | Seg7LastVal |
| Offset Addr | 0 | $-(2^M/4-1)$ | $-(2^M/2-1)$ | $-(3*2^M/4-1)$ | 0 | $-(2^M/4-1)$ | $-(2^M/2-1)$ | $-(3*2^M/4-1)$ |

SFT_RIGHT= 0

(d)

WAVEFORM GENERATION FOR FM SYNTHESIS

The present application claims the benefit of U.S. Provisional Application Ser. 60/723,343, which was filed on Oct. 4, 2005.

BACKGROUND

The present invention relates generally to frequency modulation (FM) synthesis, and, more particularly, to a method and system for generating audio waveforms used in FM music sound synthesis.

The reproduction of common waveforms in general, and of instrument sounds in particular, requires a collection of the primary components of that sound that when appropriately processed, can create a replica of that sound. The most accurate but impractical method would be a recording of that sound that includes all of its variants in frequency, attack, etc. Practical methods reduce the set of parameters needed to reproduce the sound. In the case of wavetable synthesis, each instrument is recorded and sampled over a small number of pitch cycles, over a subset of octaves. These sampled recordings are stored in a wavetable, and reproduction of the sound involves looping over this table.

FM synthesis replicates instrument sounds and therefore can be used as a synthesizer in music reproduction. Compared to the other methods of music generation, FM synthesis requires the least amount of memory for the music reproduction process while still maintaining an acceptable integrity of the instrument sound. It requires substantially less ROM and/or RAM memory for this synthesis method since it needs only a small set of pre-defined waveforms stored as a set of look-up wavetables. Wavetable synthesis, on the other hand, requires a much greater amount of memory in order to achieve an acceptable level of performance. In an example case where FM synthesis requires about 24 KB of instrument synthesis data comprising of the waveform tables, wave shaping data, and the wavetable synthesizer would require at least 512 KB of wavetable memory. This is a factor of 21 times the data size requirement for FM synthesis.

Besides the distinctive amplitude envelopes of sound produced from an instrument, sidetones create the timbre that distinguishes one instrument sound from another. Since sidetones are a naturally occurring and analytically derivable effect from performing frequency modulation on predefined waveforms, audio FM synthesis can be used to simulate instrument sounds. This is accomplished by matching the sidetones of the FM synthesized waveforms with the real instrument sidetones. A most basic FM synthesis tone generator uses a modulator frequency for self-modulation and to modulate a carrier frequency.

FIG. 1 illustrates a block diagram of this basic FM synthesis tone generator 100. The FM synthesis tone generator 100 uses a frequency of a modulator 102 to perform self-modulation (103) and to modulate a frequency of a carrier 104. A waveform wavetable index, $\phi_m[n]$, is calculated from the sum of the modulator frequency, $$2\pi\frac{f_m}{f_s}[n],$$

and a portion of the modulator signal, $\beta r[n-1]$. The waveform wavetable index is then used with a waveform look-up wavetable 106 to generate the first sequence of output samples $W_1[n]$. A gain factor ($A_m[n]$) is applied to this output resulting in $r[n]$, where $r[n]=A_m[n]W_1[n]$. The delayed portion of this signal, $\beta r[n-1]$, is then fed back to the modulator to calculate the next sample's modulator wavetable index. The amount fed back is determined by a gain factor ($\beta$), representing the modulator's frequency deviation. A portion of modulator signal, $\alpha r[n]$, is also fed forward to modulate the carrier frequency after a carrier gain factor, $\alpha$, is applied. The carrier frequency, $$2\pi\frac{f_c}{f_s}[n],$$

is summed with $\alpha r[n]$ resulting in the wavetable index, $\phi_c[n]$. This value is used with a wavetable 108 to yield the second sequence of output samples, $W_2[n]$. A carrier gain factor, ($A_c[n]$), is then applied to obtain the final simulated instrument sound, $S_{FM}[n]$, where $S_{FM}[n]=A_c[n]W_2[n]$. Using this type of synthesis requires only a few waveform wavetables. For example, six waveform tables may be used to reproduce all of the 128 General MIDI instruments and 47 General MIDI drums.

FM synthesis may be chosen as the tone generator for music reproduction because of the economical benefits resulting from a smaller wavetable size requirement. This small set of waveforms placed in look-up wavetables would need substantially less ROM and/or RAM memory for this synthesis method.

In one implementation, the look-up waveform wavetables contain a complete cycle of all the necessary waveforms. The software algorithm computes a wavetable step index calculated from the carrier and modulator frequencies. This step index is accumulated and used to acquire each sample of the carrier and modulator waveforms from the appropriate wavetable. A simple wrapping algorithm (cycle-modulo arithmetic) is used to reproduce the continuous stream of the waveform. This single-cycle wrapping algorithm requires the minimum number of instruction cycles needed to recreate the carrier and modulator waveforms.

In another implementation, the symmetry of the waveforms can be used to reduce the memory size significantly since only part of a cycle (e.g., ¼ of a cycle or ½ of a cycle) of one of the waveforms is needed to generate all of the waveforms. Complex waveforms can be further created through segmentation of the cycle stored. This requires a more complex software wavetable look-up algorithm. The segments of the accumulated wavetable index has to be calculated, modulo arithmetic over the reduced cycle and full cycle needs to be performed, shifting of the index has to be done to adjust the step size, and a segment modification wavetable has to be used to scale the waveform within a segment.

However, the conventional wavetable look-up algorithm used today for FM synthesis systems experiences several drawbacks. For the aforementioned first implementation, a larger size memory device may be required since a full cycle of the waveform is stored. As such, when more wavetables are needed to be stored, a bigger memory device is needed. A large memory device can consume a larger physical area, thus increasing the die size, cost, and the power consumption of the chip. The access time to a large memory device is also higher than a small memory device, and it is also possible for timing violations to occur. A problem with timing violations is typically very costly to repair.

For the aforementioned second implementation that takes advantage of the symmetry and similarity of the waveform cycles, a smaller memory device is needed at the expense of an increase in instruction cycle usage. The increase is significant, and is doubled in FM synthesis since the wavetables are accessed twice per sample, once for the modulator frequency and once for the carrier frequency.

Therefore, it is desirable to implement a wavetable look-up algorithm that can reduce the memory size as well as the processor load.

SUMMARY

There is a need for the following embodiments. Of course, the invention is not limited to these embodiments.

According to a first aspect of the invention, a method for generating one or more predetermined waveforms from one or more contiguous segments of at least one prototype waveform stored in one or more memory tables, comprises iterations of the following sample processing steps: reading at least one sample of the stored prototype waveform at a predetermined address, modifying the sample according to a predetermined logic, and accumulating the modified sample, wherein through a predetermined number of iterations of above steps, a cycle of a new waveform is formed by the accumulated modified samples.

According to a second aspect of the invention, a method for generating one or more predetermined waveforms from one or more contiguous segments of at least one prototype waveform stored in one or more memory tables comprising iterations of following sample processing steps: loading a first register with at least one address pointer, shifting the first register by a predetermined number of bits for providing a table address, reading at least one sample of the stored prototype waveform at the table address, providing a predetermined segment modification matrix table with a predetermined number of rows and a predetermined number of columns, selecting a column of the predetermined segment modification matrix table by an address provided by the first register, loading a second register with at least one row select address, selecting a row of the predetermined segment modification matrix table by an address provided by the second register, selecting a predetermined logic based on the content of the predetermined segment modification matrix table at the selected row and column, modifying the sample according to the predetermined logic (−1, 0, 1), and accumulating the modified sample, wherein through a predetermined number of iterations of the above steps, a cycle of new waveform is formed by the accumulated modified samples.

According to a third aspect of the invention, a waveform generating system with one or more contiguous segments of at least one prototype waveform stored in one or more memory tables, the waveform generating system comprising: at least one modification logic module for modifying at least one sample of the prototype waveform according to a predetermined logic set, at least one segment modification matrix table for selecting a logic operation from the predetermined logic set for modifying the samples, a first register for storing a column select address of the segment modification matrix table, a second register for storing a row select address of the segment modification matrix table, wherein a content at a selected column and row of the segment modification matrix table determines the selection of the logic operation, and at least one shift module for shifting the content of the first register by a predetermined number of bits for providing a table address to read a predetermined sample of the prototype waveform from the memory tables.

The construction and method of operation of the invention, however, together with additional objects and advantages thereof will be best understood from the following description of specific embodiments when read in connection with the accompanying drawings.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein. It should be noted that the features illustrated in the drawings are not necessarily drawn to scale.

DESCRIPTION

The following will provide a detailed description of a waveform generation method and system applicable in both hardware and software that can implement wavetable look-up algorithm in hardware, so that the increase in the processing cycles introduced by the more complex algorithm is eliminated. The present invention can reduce memory size, memory access time and processor instruction cycle usage at the same time.

Figure 1:
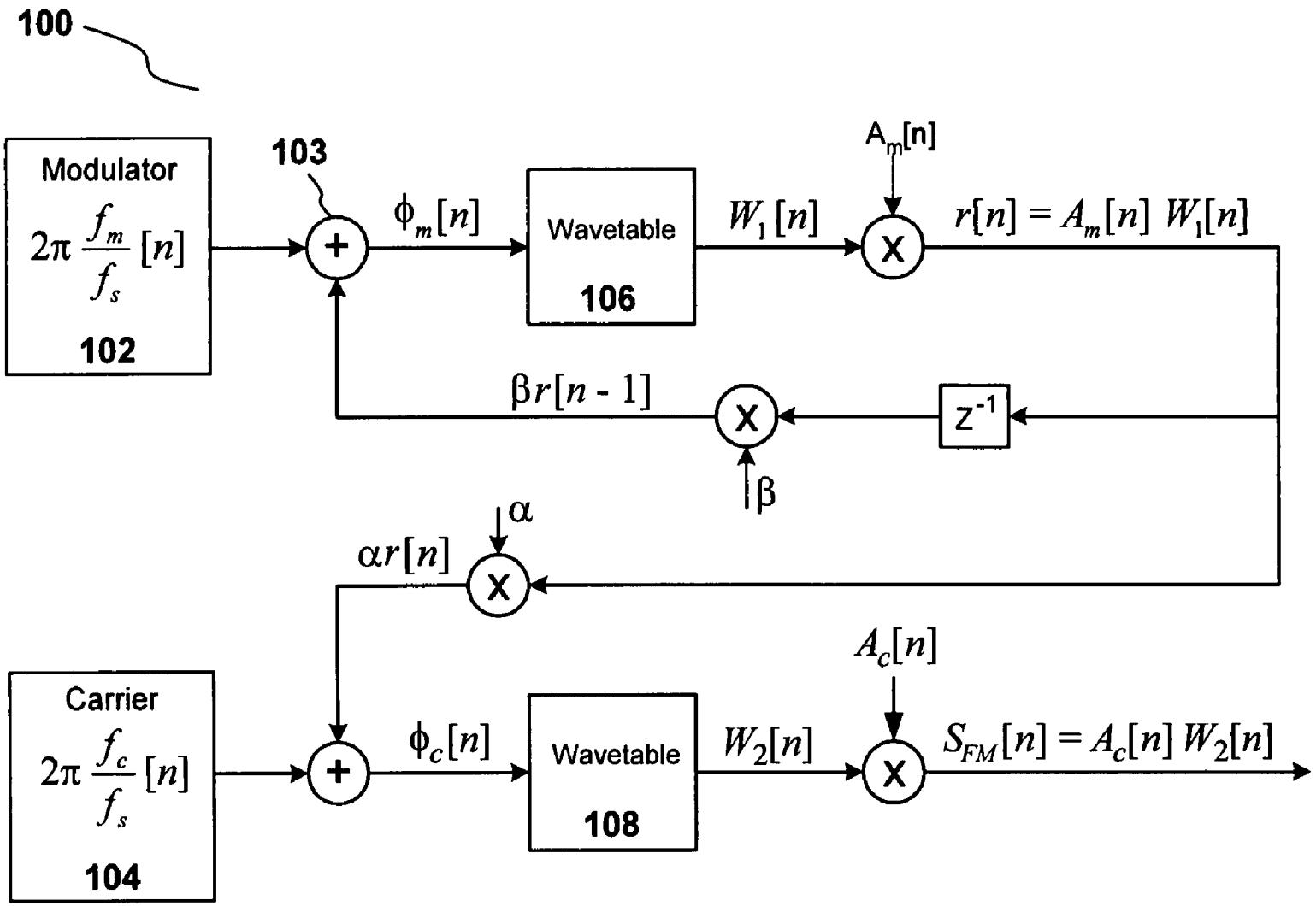
FIG. 1 (Prior Art)
FIG. 1 is a block diagram illustrating a conventional FM synthesis tone generator that uses a frequency of a modulator for self-modulation and to modulate a frequency of a carrier.

FIG. 1 has already been described and discussed as the relevant background to the present invention. It requires no further discussion here.

To obtain a desired waveform, a prototype waveform is first selected, and then properly segmented and the amplitude is adjusted. The segmented and amplitude adjusted prototype waveform is then used to generate the desired and often more complex waveforms. The selection of the prototype waveform depends on applications. For example, in audio FM synthesis, the prototype waveform can be a sine, saw-tooth, ramp or exponential wave. Any waveform can be used as the prototype waveform as long as it has utilizable symmetry.

Figure 2A:
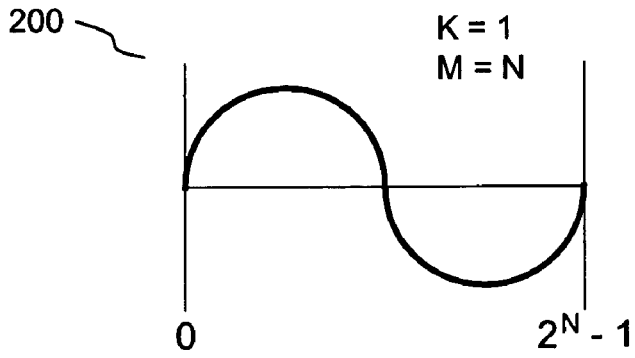
FIG. 2A illustrates an exemplary prototype waveform.

FIG. 2A illustrates a prototype waveform 200 that is specified with a period of $2^N$ samples, where N is an integer. It is then partitioned into $2^K$ equally spaced segments, each with $2^{N-K}$ samples. By partitioning the prototype waveform 200, the symmetries of the waveform 200 can be exploited, thereby allowing the generation of a large number of possible output waveforms. For example, assuming N=11 and K=2, there will be $2^{11}$, or 2048, samples and $2^2$, or 4, segments, where each segment has 512 samples.

A memory table may be used to store one or more contiguous segments of the prototype waveform. The memory table used to store such information may be RAM or ROM. However, other methods of storing data (e.g., flip flops) may be implemented to meet the design criteria of a particular implementation. The memory table has a length equal to $2^M$, where M satisfies the relations N−K<=M<=N. For example, assuming N=11, K=2, and M=10, there will be 2048 samples for one period of the waveform and 4 segments, where each segment has 512 samples. In this example, the memory will contain $2^{10}$ or 1024 samples.

Figure 2B:
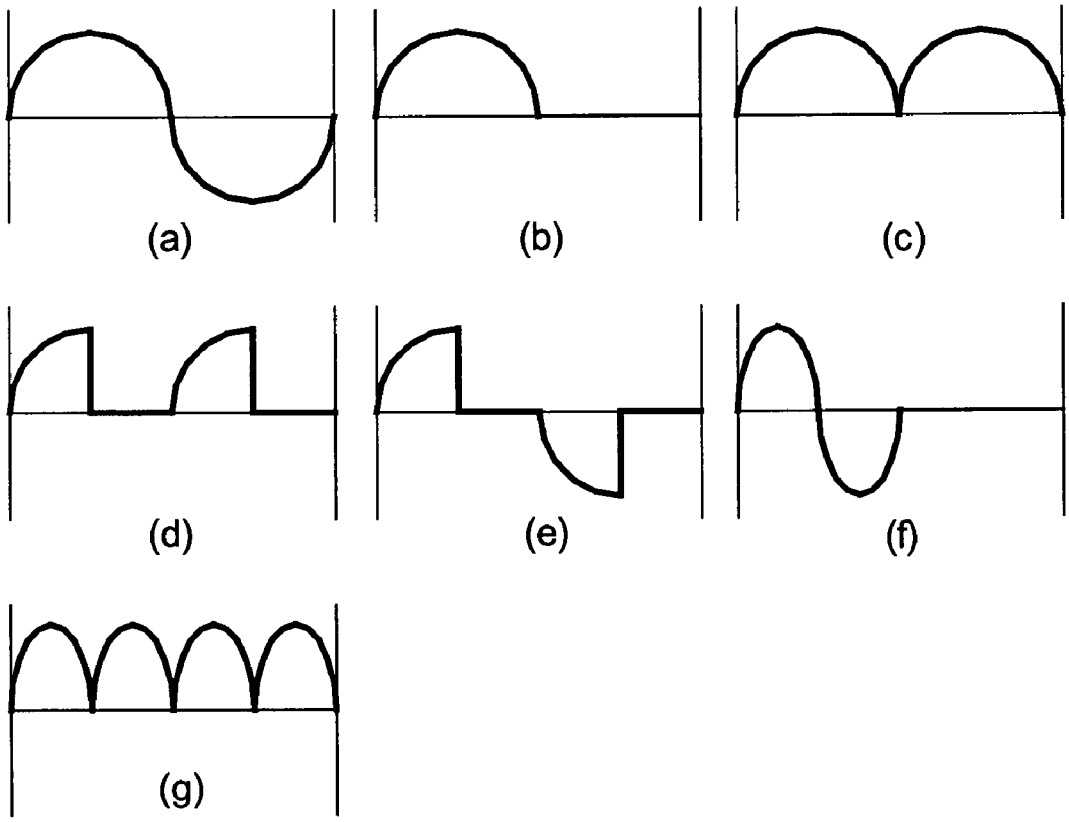
FIG. 2B illustrates seven waveforms generated from the prototype waveform shown in FIG. 2A.

FIG. 2B illustrates seven waveforms (a~g) that are generated from the prototype waveform 200 using the aforementioned partitioning technique where K=1 and M=N. These are just examples, and numerous other waveforms can also be generated from the prototype waveform 200.

Using the same prototype waveform 200 from FIG. 2A, the level of complexity can be increased by dividing the prototype waveform 200 into a greater number of segments defined by K. In addition, the frequency of the waveform can be increased or decreased by doubling or halving the step into the wavetable. This can be done by bit shifting (multiplying or dividing by 2) the step value right or left.

Figure 2C:
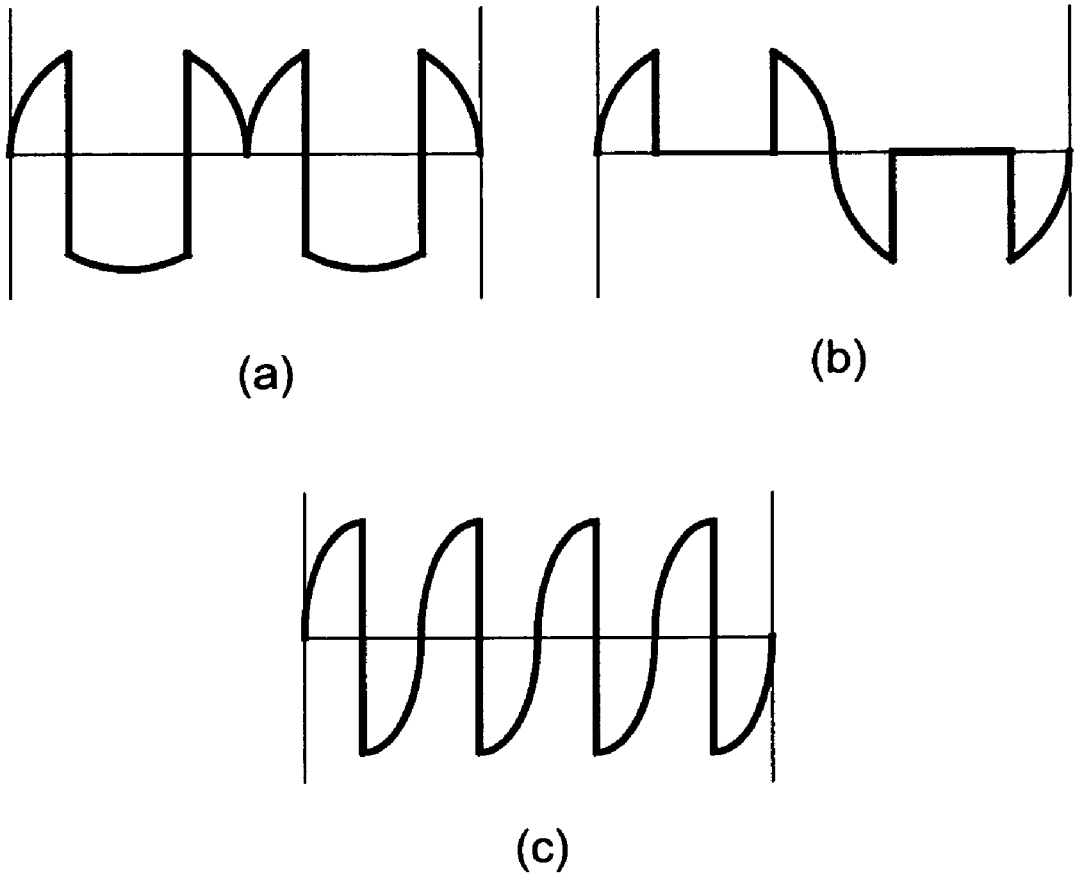
FIG. 2C illustrates three more waveforms generated from the prototype waveform shown in FIG. 2A.

FIG. 2C illustrates three of the possible waveforms that could be generated by increasing the number of segments to eight and as well as bit shifting to the left or right of the segments of the prototype waveform.

Figure 3:
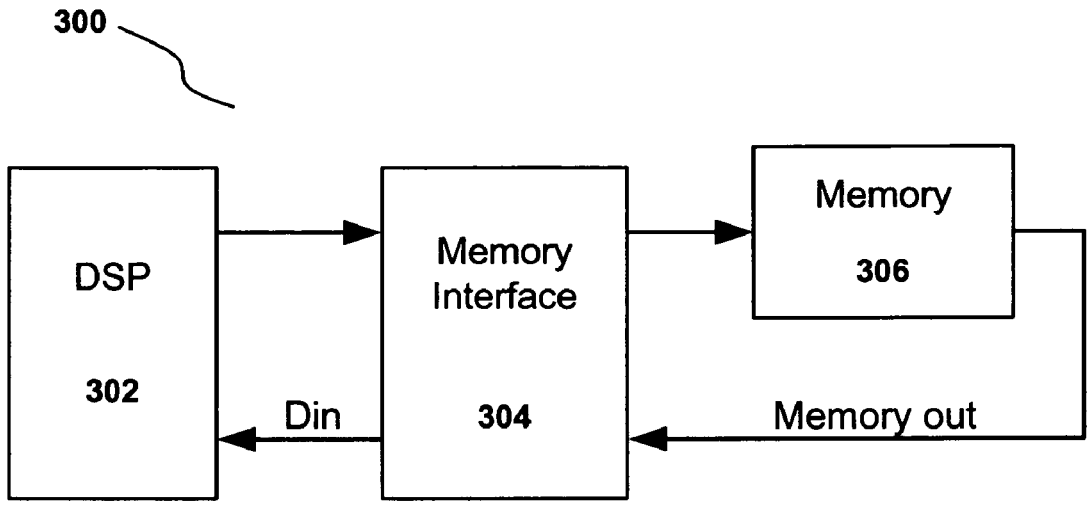
FIG. 3 is a block diagram illustrating a general concept of a proposed waveform generation system in accordance with one embodiment of the present invention.

FIG. 3 is a block diagram illustrating the general concept of a proposed waveform generation system 300 in accordance with one embodiment of the present invention. The waveform generation system 300 demonstrates the relationship among following three hardware devices: a digital signal processing (DSP) block 302, a memory interface block 304, and a memory device 306. The memory device 306 is designed to contain one or more contiguous segments of the prototype waveform, such as the prototype waveform 200 shown in FIG. 2A. The DSP block 302 can access the waveforms within the memory device 306 through the memory interface block 304. The memory interface block 304 generates the address and other signals that are needed in order to read from the memory device 306. The memory interface block 304 is also designed to modify the output data according to control registers within the memory interface block 304 (not shown) that were programmed by the DSP block 302, and this modified data is read by the DSP block 302.

Note that the software implementation of this algorithm or method requires not only cycle modulo arithmetic but also partial-cycle modulo arithmetic for the fraction of the cycle actually stored. Segment modulo arithmetic needs also to be done to indicate the segment, and a new table needs to be defined to designate the polarity of each segment for all desired waveforms.

The memory interface block 304 is designed to perform the cycle, partial-cycle and segment modulo arithmetic from the wavetable phase step. A table of the reduced size waveform and a table of segment polarity are accessed to produce the sample output. Performing all the operations in software incurs a large cycle cost, so using a memory interface in hardware is preferred.

During FM synthesis, modulator sample processing occurs followed by carrier sample processing. With this method, during sample processing, the software calculates for each sample a phase step. This value and the waveform type are passed to the memory interface hardware where the cycle, partial-cycle and segment modulo arithmetic are first performed. Segment polarity modification (no change, negate or zero) is then applied to yield an output sample value.

Figure 4:
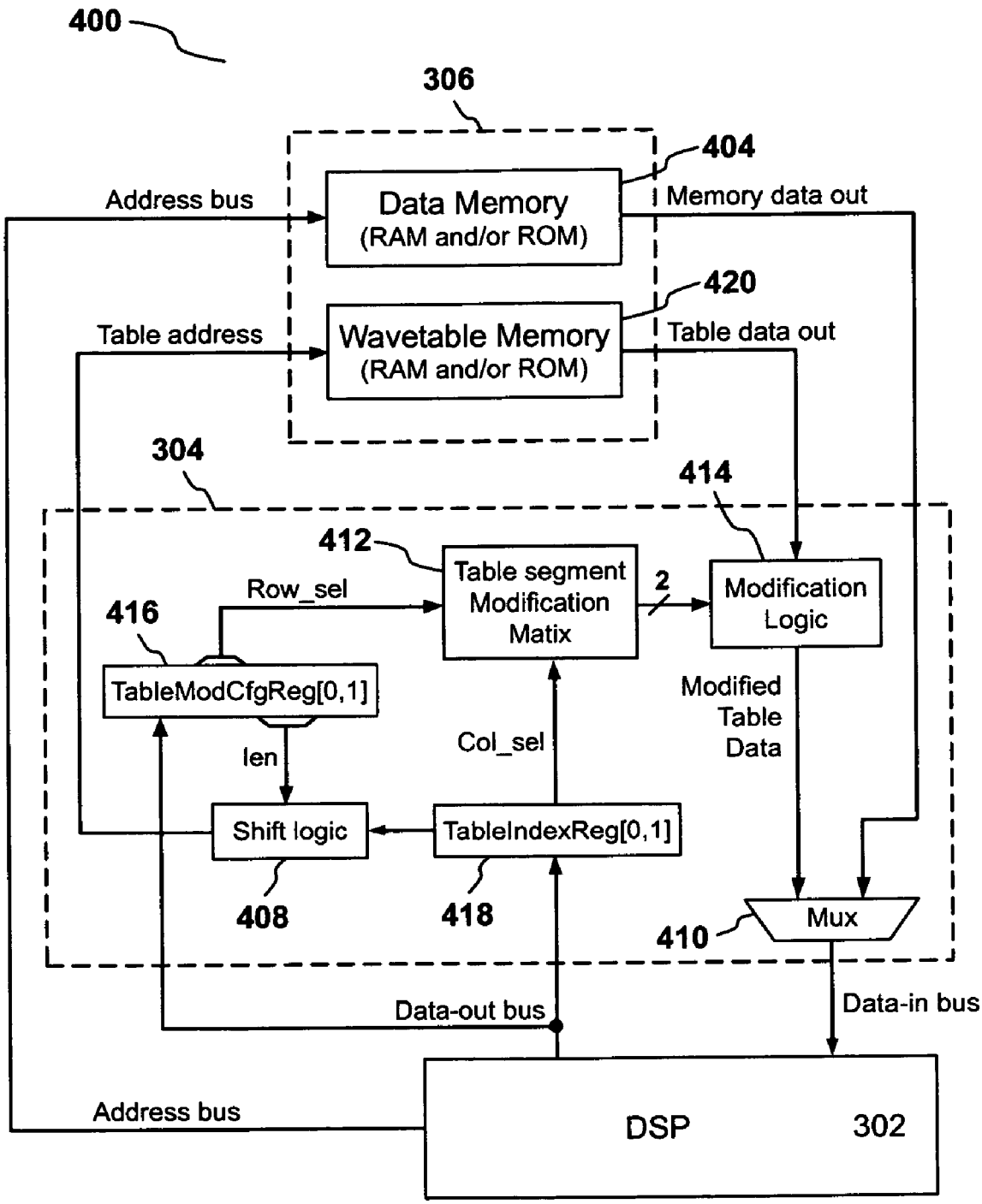
FIG. 4 is a detailed block diagram illustrating an implementation of the proposed waveform generation system in accordance with one embodiment of the present invention.

FIG. 4 is a block diagram illustrating a more detailed waveform generation system 400 in accordance with one embodiment of the present invention. The waveform generation system 400 comprises a processor 302, which is a DSP in this example, to be interfaced with a data memory module 306 that may include RAM, ROM, or both. The processor 302 is also interfaced with a memory interface block 304, which comprises a shift logic device 408, a multiplexer 410, a segment modification matrix table 412, a modification logic 414, and two sets of registers 416 and 418. The register set 416 contains a TableModCfgReg[0] register and a TableMod CfgReg[1] register, while the register set 418 contains a TableIndexReg[0] register and a TableIndexReg[1] register. A waveform wavetable memory module 420, which includes RAM and/or ROM, is also implemented for storing the $2^M$ samples that make up a part of a cycle (e.g., ½ cycle) of the prototype wave. The processor 302 is designed to have direct access to the data memory module 404 while the data within waveform wavetable memory module 420 is only accessible through the memory interface 304.

In the beginning of a waveform generation, the processor 302 writes to the registers TableModCfgReg[0] and Table ModCfgReg[1] within the register set 416. Those registers 416 may contain information that is needed throughout the processing and generation of a waveform, such as a pointer for the segment modification matrix table 412 that selects one of the rows. The TableModCfgReg[0] register is used when the modulator sample processing is performed. The Table ModCfgReg[1] register is used when the carrier sample processing is performed. The segment modification matrix table 412 contains Y rows (Y is an integer), one for each required waveform, and $2^K$=X columns (X is an integer), one for each segment of the prototype waveform. For example, if 6 waveforms are supported and the prototype waveform is divided into 4 segments (quadrants), Y is equal to 6 and X is equal to 4. Therefore, the segment modification matrix table 412 for this example has a size of 6×4. The signal Col_sel, supplied by the TableIndexReg[0,1] 418, determines which column of the segment modification matrix table 412 will be selected. Each column of the segment modification matrix table 412 contains control bits to be applied to the modification logic 414 during its respective segment of the prototype waveform.

Each row matrix consists of the $2^K$-segment multipliers for reproducing a complete cycle modulator and carrier waveform. The output of the segment modification table 412 is used to modify the read memory output data. Table 1 shows a sample content of the segment modification matrix table 412.

When a row and a column are selected, a certain number or key at the selected row and column will be chosen and sent to the modification logic 414.

TABLE 1

| | | | |
|---|---|---|---|
| 01 | 01 | 11 | 11 |
| 01 | 11 | 00 | 00 |
| 01 | 00 | 01 | 00 |
| . | . | . | . |
| . | . | . | . |
| . | . | . | . |
| 01 | 01 | 01 | 01 |

The modification logic 414 gets the output of the segment modification matrix table 412 and modifies the data according to the selected key. In an example set of predetermined keys, 2-bit keys may be used, where 00 represents zero outputs, 01 represents no changes and 11 represents negate as shown in Table 2. Note that other options and/or keys can be used to meet the design criteria of a particular implementation.

TABLE 2

| Segment modification matrix Table output | Modification logic output |
|---|---|
| 00 | Zero output |
| 01 | No change |
| 11 | Negate |

The processor 302 calculates a wavetable step index and writes the value to one of the registers in the register set TableIndexReg[0,1] 418. As generating an FM synthesis waveform requires modulator sample processing followed by carrier sample processing, when the modulator sample processing is performed the TableIndexReg[0] register is used, and when the carrier sample processing is performed the TableIndexReg[1] register is used. The processor 302 writes to each of the registers in the register set 418 once per sampling.

The value in the register set TableIndexReg[0,1] 418 may be bit shifted by the shift logic device 408 and the shifted value becomes the address for reading the wavetable memory 420. Data output from the wavetable memory 420 may be modified by the modification logic 414, and the modified data value is put on the data-in bus of the processor 302.

For the shift logic device 408, the SFT_RIGHT operation performs a base 2 increase or decrease of the frequency of the waveform. For SFT_RIGHT=0 the frequency of the original waveform remains the same. For SFT_RIGHT=1, the frequency doubles and for the SFT_RIGHT=−1, the frequency is halved. The read operation causes a reading from the wavetable memory module 420 according to the address provided by the shift logic device 408.

The data space of processor 302 may include data memory 404 to support other functions, which are not related to this invention. The processor 302 has a direct access to the data memory 404. The read data goes to the data-in bus of the processor 302 through a multiplexer 410. Multiplexer, 410, is needed when there is more than one source that can put data on the data-in bus of the processor 302.

Note that the data memory module 404 and the wavetable memory module 420, while depicted as two logical memory blocks, can be combined into one contiguous block of physical memory. In that case, additional logic (e.g., a decoder and a multiplexer, not shown in FIG. 4) is needed in order to allow a direct access to the data memory by the processor 302 when needed, or an access through the memory interface 304 when the processor generates an FM synthesized waveform.

Figure 5A:
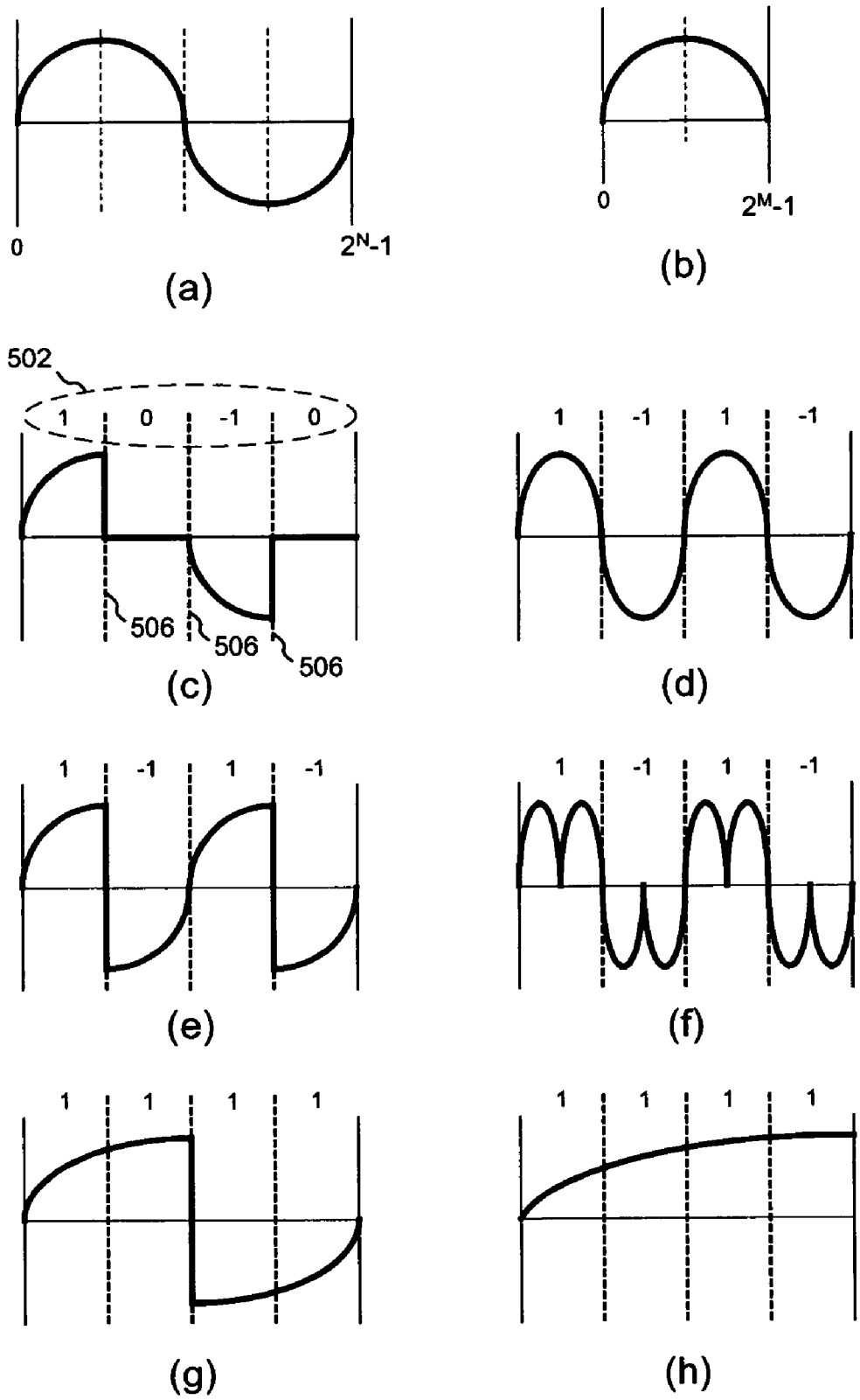
FIG. 5A shows some exemplary waveforms generated using four segments by the proposed waveform generation system shown in FIG. 4.

FIG. 5A shows some exemplary waveforms generated using four segments as proposed by the waveform generation system shown in FIG. 4. FIG. 5A(a) shows a prototype waveform. FIG. 5A(b) shows a reduced waveform loaded in the wavetable memory 420 shown in FIG. 4. FIG. 5A(c) shows a particular generated waveform, where the numbers inside the dotted oval, 502, are modification values extracted from the segment modification matrix table, 412, and vertical dotted straight lines, 506, mark the transitions of the columns of the segment modification matrix table, 412. In subsequent drawings, the encircled numbers, 502, and the vertical dotted straight lines, 506, will bear the same definitions, unless otherwise noted, and therefore will not be repeated. Beside the modification values within the segment modification matrix table differing as illustrated in FIG. 5A(c) through (h), the SFT_RIGHT values also differ. TABLE 3 presents the SFT_RIGHT value used for generating individual waveforms (c) through (h).

TABLE 3

| FIG. 5A | SFT_RIGHT |
|---|---|
| (c) | 0 |
| (d) | 1 |
| (e) | 0 |
| (f) | 2 |
| (g) | −1 |
| (h) | −2 |

Figure 5B:
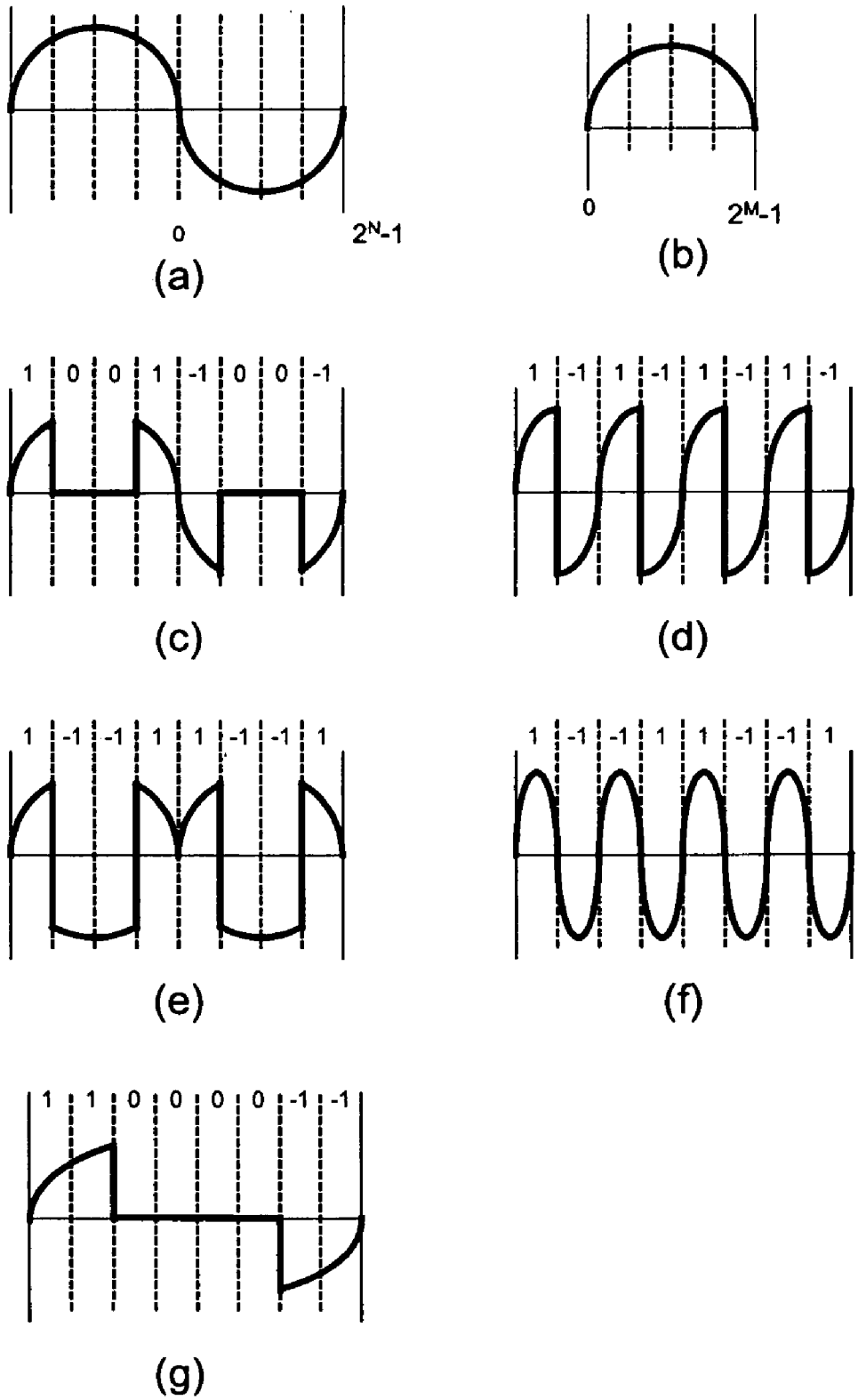
FIG. 5B shows some exemplary waveforms generated using eight segments by the proposed waveform generation system shown in FIG. 4.

FIG. 5B shows some exemplary waveforms generated using eight segments by the proposed waveform generation system shown in FIG. 4. FIG. 5B(a) shows a prototype waveform. FIG. 5B(b) shows a reduced waveform loaded in the wavetable memory 420 shown in FIG. 4. FIG. 5B(c)~(h) shows generated waveforms using different modification values from the segment modification matrix table, 412 (FIG. 4), which are noted in each waveforms, and different SFT_RIGHT values presented in following the TABLE 4.

TABLE 4

| FIG. 5B | SFT_RIGHT |
|---|---|
| (c) | 0 |
| (d) | 1 |
| (e) | 0 |
| (f) | 2 |
| (g) | −1 |

Figure 6:
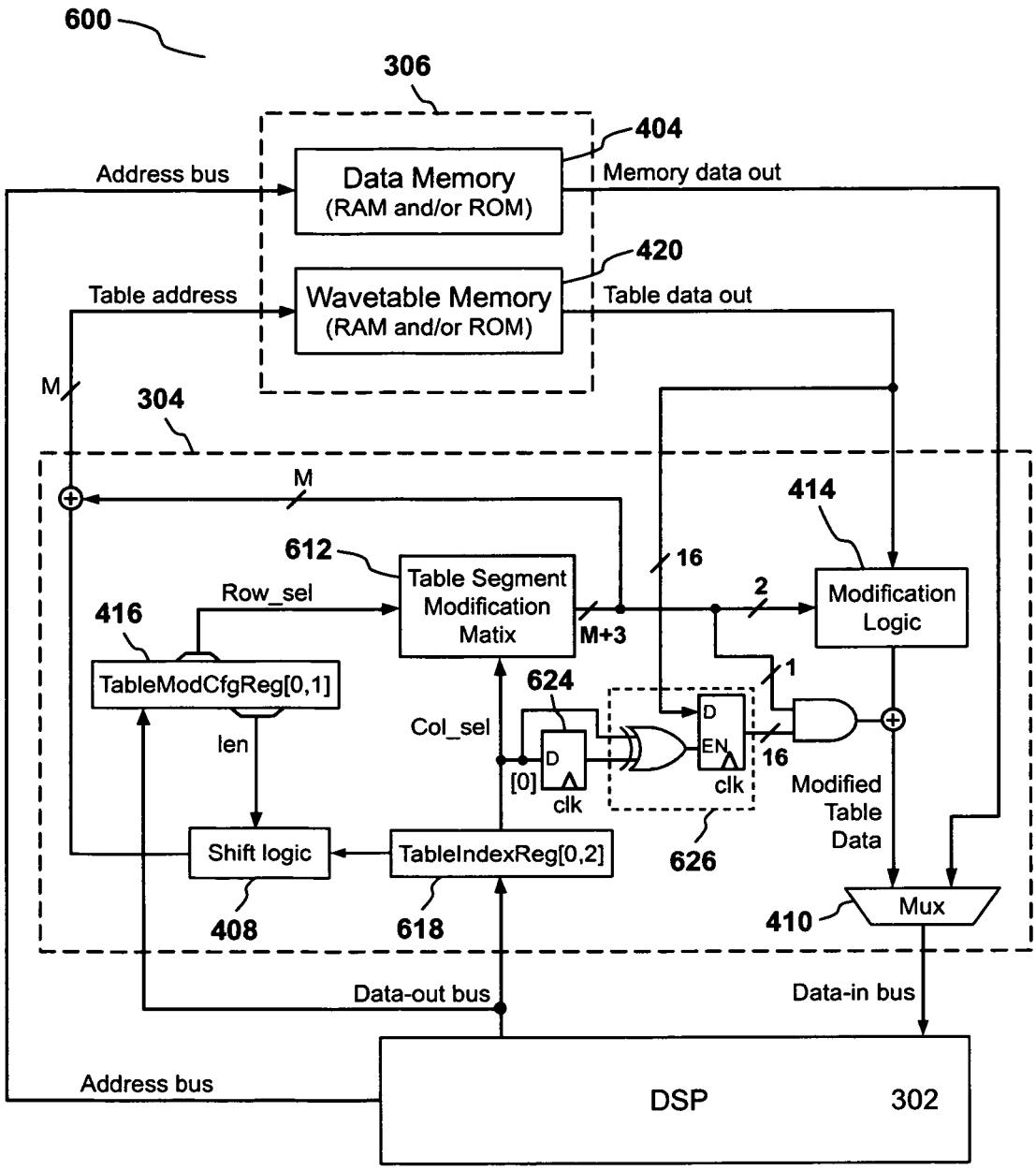
FIG. 6 is a detailed block diagram illustrating an implementation of a more complex waveform generation system in accordance with another embodiment of the present invention.

FIG. 6 is a detailed block diagram illustrating an implementation of a more complex waveform generation system 600 in accordance with another embodiment of the present invention. The waveform generation system 600 is similar to the system 400 of FIG. 4 with the exception of changes made within a memory interface block 304 where address offset summation and amplitude offset summation are used. Like the system 400 of FIG. 4, system 600 still utilizes the processor 302, the data memory module 404, and the wavetable memory module 420. Within the memory interface block 304, the register sets 416 and 618, the shift logic device 408, the multiplexer 410, and the modification logic 414 are still implemented in similar manners. The memory interface block 304 may contain an amplitude offset summation. A simple comparator 626, comprising a flip-flop and a XOR logic gate, is implemented to detect a transition to a new segment. For each segment transition a value is stored, which may be the last value of the previous segment or a predetermined offset. According to an additional control bit in the segment modification matrix table 612, the stored value may be added to the output of the modification logic 414 of all the values of the current segment. The memory interface block 304 may contain an address offset summation. Each column of the segment modification matrix table 612 may contain an offset address in addition to the other control bits. Other ways to supply the offset address (e.g., a separate lookup table) may be implemented to meet the design criteria of a particular implementation. The stored offset address is then added to the calculated address from the shift logic device 408, for all the samples of the specific segment, and the accumulated address is used in the access to the wavetable memory module 420. A different segment modification matrix table 612 is used for this design since each segment multiplier contains an additional control bit as well as offset addresses. Table 5 shows one possible example of the new segment modification matrix table 612 for N=11, M=10 and K=2 (4 segments). Since M=10, for this example, there are 10 bits for the offset address as well as other control bits. These particular row entries would be the values used for generating more complex waveforms shown in FIGS. 7A(c), (d) and (e).

TABLE 5

| FIG. | Segment 1 | Segment 2 | Segment 3 | Segment 4 |
|---|---|---|---|---|
| 7A(c) | 0000000000001 | 1111111111111 | 0000000000001 | 1111111111111 |
| 7A(d) | 0000000000001 | 1111111111111 | 01111111111101 | 0000000000011 |
| 7A(e) | 0111111111111 | 1111111111101 | 0111111111111 | 1111111111101 |

Figure 7A:
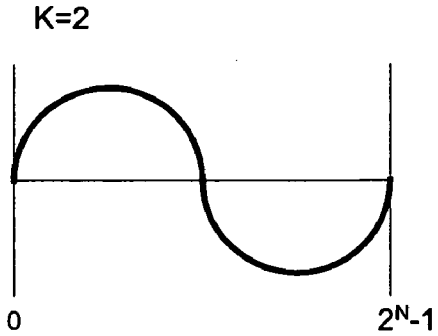
FIG. 7A~7C shows some exemplary waveforms generated by the proposed waveform generation system shown in FIG. 6.
Figure 7A:
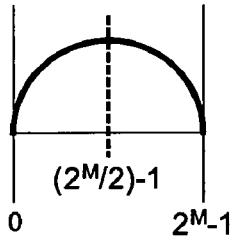
Figure 7A:
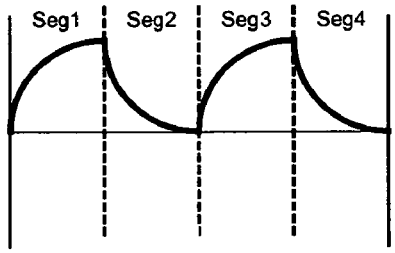
Figure 7A:
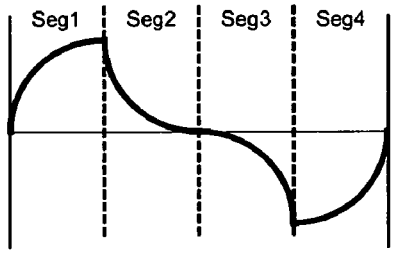
Figure 7A:
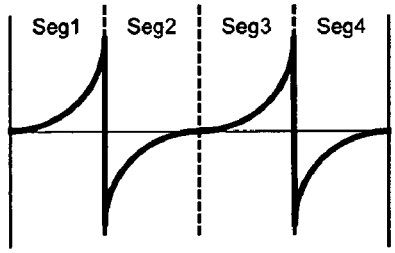

FIG. 7A shows some exemplary waveforms generated by the proposed waveform generation system shown in FIG. 6. Four segments are used in generating these waveforms. FIG. 7A(a) shows a prototype waveform. FIG. 7A(b) shows the reduced waveform loaded in the wavetable memory of the waveform generation system 600. Values of segment modification matrix table, 612 and SFT_RIGHT as well as offset parameters used in performing the waveform generation are displayed next to respective waveforms in FIG. 7A. The parameter "Offset Sum" stands for amplitude offset summation, and the parameter "Offset Addr" stands for offset address. These values and parameters are also displayed in FIGS. 7B and 7C next to their respective waveforms, and they are not further noted when discussing those figures.

Figure 7B:
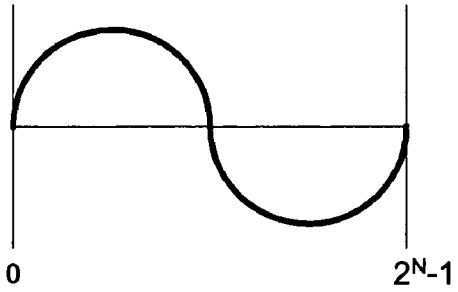
Figure 7B:
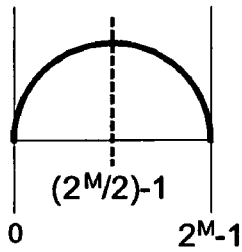
Figure 7B:
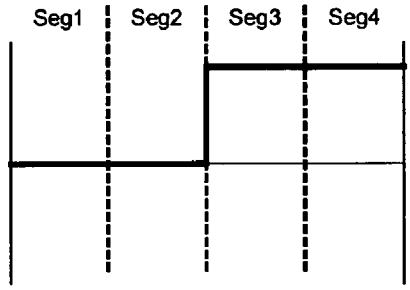

FIG. 7B shows a unique waveform generated by the proposed waveform generation system shown in FIG. 6. Four segments are also used in generating these waveforms. FIG. 7B(a) shows a prototype waveform. FIG. 7B(b) shows a reduced waveform loaded in the wavetable memory of the waveform generation system. Using this design, a square-wave can be generated as shown in FIG. 7B(c).

Figure 7C:
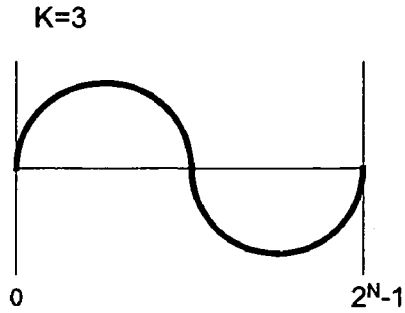
Figure 7C:
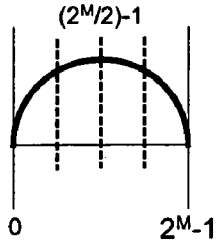
Figure 7C:
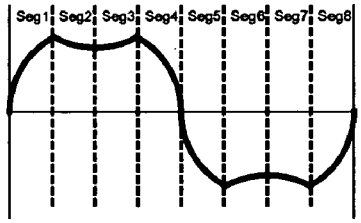
Figure 7C:
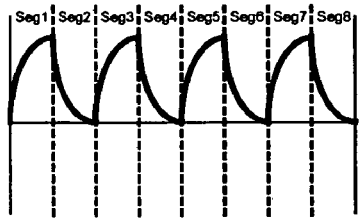

FIG. 7C shows two more waveforms generated by the proposed waveform generation system shown in FIG. 6. Here, eight segments are used in generating these waveforms. FIG. 7C(a) shows a prototype waveform. FIG. 7C(b) shows the reduced waveform loaded in the wavetable memory of the waveform generation system. FIG. 7C(c) and (d) are complex waveforms generated using the values and parameters displayed next to the waveforms.

Generation of such complex waveforms would require a significant increase in instructions and data, however, with a modification to the memory interface and an addition of a few logic gates, the software operation stays the same, and the generation of the more complex waveforms does not increase the instruction cycle usage of the processor 302.

With this method, when the prototype waveform is divided into more segments, other FM waveforms with higher complexity can be created, possibly improving the replication of the instrument sounds.

Other modifications and various changes to the memory interface module 304 other than what is presented in the foregoing paragraphs may be possible in order to generate FM synthesized waveforms or any other type of waveforms, without departing from the spirit and scope of the invention.

Figure 8:
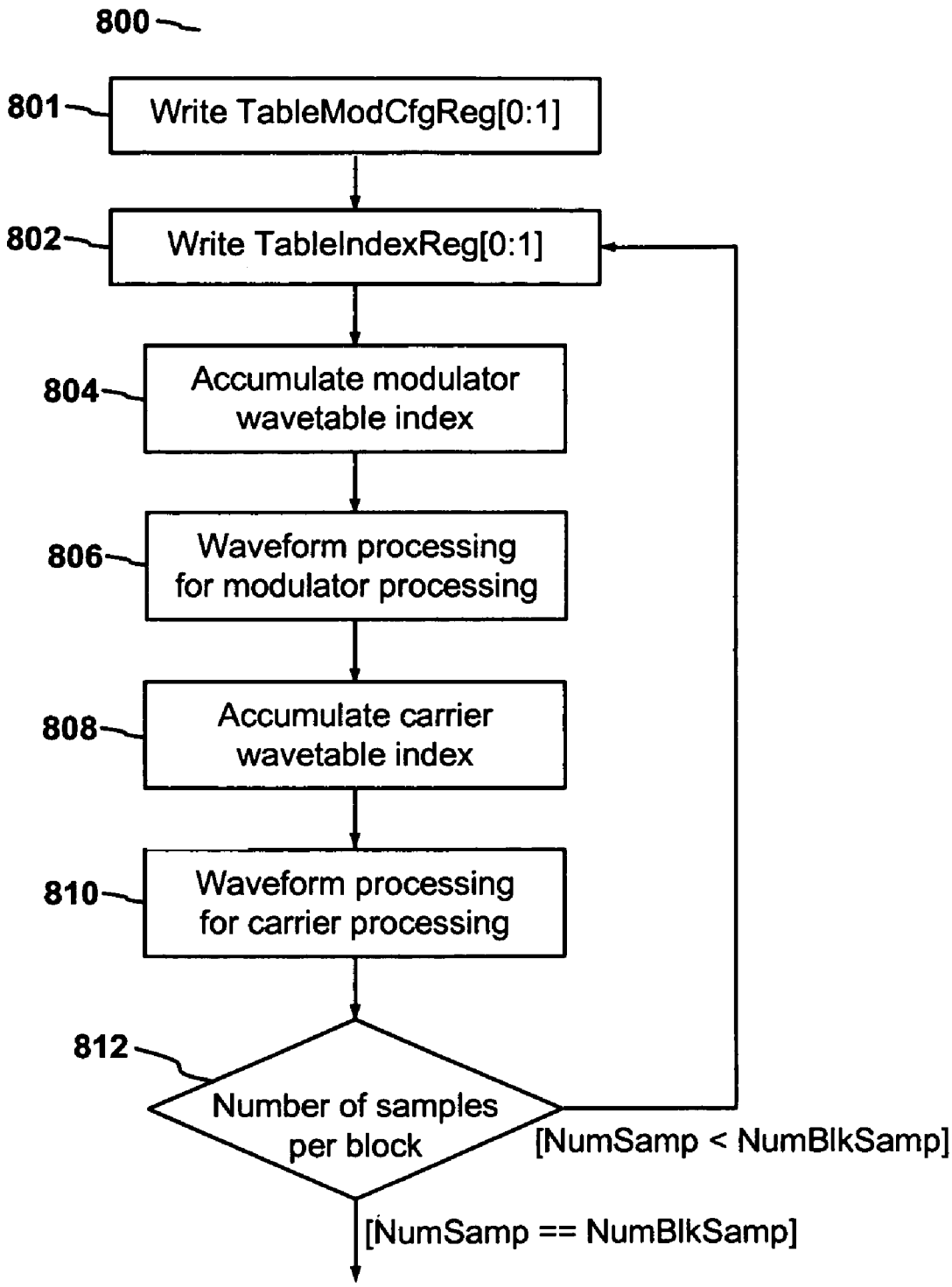
FIG. 8 is a flow chart illustrating the proposed waveform generation method implemented in software in accordance with one embodiment of the present invention.

FIG. 8 is a flow chart illustrating an implementation method 800 of the complex wavetable look-up algorithm in accordance with the embodiments of the present invention. In step 801, the configuration parameters of the registers TableModCfgReg[0] and TableModCfgReg[1] are preloaded by a DSP before sample processing. These registers are the address of the segment polarity modification matrix that is used during modulator and carrier sample processing. This matrix consists of a segment multiplier for reproducing a cycle of modulator processing and carrier processing waveforms. The TableModCfgReg[0] register is used when the modulator sample processing is performed in steps 804 and 806. TableModCfgReg[1] register is used when the carrier sample processing is performed in steps 808 and 810. The registers may contain the row select of the segment modification matrix table, which chooses the waveform wavetable that is going to be used throughout the modulator and carrier sample processing. It may contain the length of the shift-right operation.

In step 802, the DSP loads registers, and TableIndexReg [0,1], once per sampling. These registers determine which column of the segment modification matrix table may be selected (referring to FIGS. 4 and 6). As generating a FM synthesis waveform requires a modulator sample process followed by a carrier sample process. When the modulator sample processing is performed, the TableIndexReg[0] register is used, and when the carrier sample processing is performed the TableIndexReg[1] register is used.

Since the prototype waveform has $2^N$ (e.g., 2048) samples per cycle, then modulo-$(2^N-1)$ arithmetic is performed on the accumulated wavetable index for both modulator processing in step 804 and carrier processing in step 808. This operation is automatically executed by the processor writing an x-bit value to the TableIndexRegX[N−1:0] Register (X=0 or 1). For N=11, the modulo-arithmetic is done over a value of 0x7FF (or 2047).

Details of the waveform processing of step 806 or 810 are described as follows. The 'N−1' to 'N−1−K' bits of this register, TableIndexRegX[N−1:N−1−K], determines the segment of the waveform. These bits are used for addressing the corresponding column of the segment modification matrix, which provides the polarity for that segment. For example, for N=11 and K=2, the wavetable index will wrap around a value of 0x7FF, and the 4 segments ($2^K$=4) are defined in Table 6:

TABLE 6

| Segment | COL_SEL | Bit Address |
|---|---|---|
| Segment 1 | 00 | 0 to 0x1FF |
| Segment 2 | 01 | 0x200 to 0x3FF |
| Segment 3 | 10 | 0x400 to 0x5FF |
| Segment 4 | 11 | 0x600 to 0x7FF |

In step 806 or 810, the TableIndexRegX[N−1:0] register is then shifted right (SFT_RIGHT) by its length or len. The SFT_RIGHT operation accomplishes two functions: (1) performing the partial-cycle modulo-($2^M$−1) arithmetic, and (2) adjusting the prototype waveform frequency. The modulo-($2^M$−1) arithmetic serves the function of wrapping the wavetable index around the size of all or a portion of the partial waveform cycle saved in memory. For example, for N=11 and M=10, only ½ of the full cycle ($2^N$ samples) is saved in memory. Therefore, len would be N−M, or 1. For integer values larger than 1, each shift serves to double the frequency of the prototype waveform. For a len=1, the frequency of the prototype waveform remains the same and the shift right operation only functions as a wrap around the ½ cycle of the waveform. For a len=2 and 3, the prototype waveform will be respectively doubled and quadrupled in frequency. The resulting value is used as the address into the stored waveform wavetable from which the sample value is extracted.

The processor reads from a predefined address. The read operation causes a reading from the wavetable memory according to the calculated address. The sample value is modified by the segment modification matrix value (a multiply of 0, 1 or −1). This results in the final sample value that is read by the processor.

In step 812, the process checks if a predetermined number of samples per block have been reached, if not, the processor will go through another round of modulator processing and carrier processing by starting at step 802 again, otherwise, the processor will exit the processing.

Note that the present invention may be used in portions of a code division multiple access (CDMA) chipset. While the present invention may be useful in CDMA designs, the present invention may be applied to generate FM waveforms or any other type of waveforms for other designs as well.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A method for generating a waveform from one or more contiguous segments of a prototype waveform stored in a memory table, the method comprising iterations of following sample processing steps:

reading at least one sample of the stored prototype waveform at an address;

modifying the sample according to a predetermined logic;

providing a predetermined segment modification matrix table with a predetermined number of rows and a predetermined number of columns, wherein the predetermined number of rows equals the number of waveforms required to generate, and the predetermined number of columns equals the number of segments the prototype waveform is partitioned;

selecting the predetermined logic based on the content of the predetermined segment modification matrix table indicated at a selected row and a selected column; and accumulating the modified sample, wherein through a number of iterations of above steps, a cycle of a new waveform is formed by the accumulated modified samples.

2. The method of claim 1, wherein the reading further comprises:

loading a first register with at least one address pointer; and shifting the first register for providing the address.

3. The method of claim 1, wherein the reading further comprises:

loading a first register with at least one address pointer;

shifting the first register to generate a first address; and adding the first address with an offset address for providing the address.

4. The method of claim 3, wherein the offset address is stored in a predetermined segment modification matrix table.

5. The method of claim 1, wherein the predetermined logic is selected from the followings:

no-change;

negating; and zero-output.

6. The method of claim 1 further comprising:

storing a value from a current sample reading;

detecting a transition of reading the stored prototype waveform from one segment to another; and adding the stored value to a next sample reading if the next sample reading is on a new segment of the stored prototype waveform.

7. The method of claim 1 further comprising iterations of a first sample processing for a modulator waveform followed by a second sample processing for a carrier waveform, wherein both a modulator waveform and a carrier waveform are formed for frequency modulation synthesis.

8. The method of claim 1 further comprising reading a sample of the stored prototype waveform directly from the memory table without going through the sample processing steps.

9. A method for generating a waveform from one or more contiguous segments of a prototype waveform stored in a memory table, the method comprising iterations of following sample processing steps:

loading a first register with at least one address pointer;

shifting the first register for providing a table address;

reading at least one sample of the stored prototype waveform at the table address;

providing a predetermined segment modification matrix table with a predetermined number of rows and a predetermined number of columns, wherein the predetermined number of rows equals the number of waveforms required to generate, and the predetermined number of columns equals the number of segments of the prototype waveform partition;

selecting a column of the predetermined segment modification matrix table by an address provided by the first register;

loading a second register with at least one row select address;

selecting a row of the predetermined segment modification matrix table by an address provided by the second register;

selecting a predetermined logic based on the content of the predetermined segment modification matrix table at the selected row and column;

modifying the sample according to the predetermined logic; and accumulating the modified sample, wherein through a number of iterations of the above steps, a cycle of a new waveform is formed by the accumulated modified samples.

10. The method of claim 9, wherein the shifting further comprises adding a shifted content of the first register with an offset address for providing the table address.

11. The method of claim 10, wherein the offset address is stored in a predetermined segment modification matrix table.

12. The method of claim 9, wherein the predetermined logic is selected from the followings:

no-change;

negating; and zero-output.

13. The method of claim 9 further comprising:

storing a value from a current sample reading;

detecting transition of reading the stored prototype waveform from one segment to another; and adding the stored value to a next sample reading if the next sample reading is on a new segment of the stored prototype waveform.

14. The method of claim 9 further comprising iterations of a first sample process for a modulator waveform followed by a second sample process for a carrier waveform, wherein both a modulator waveform and a carrier waveform are formed for frequency modulation synthesis.

15. The method of claim 9 further comprising reading a sample of the stored prototype waveform directly from the memory table without going through the sample processing steps.

16. A waveform generating system with one or more contiguous segments of a prototype waveform stored in a memory table, the waveform generating system comprising:

a logic module for modifying at least one sample of the prototype waveform according to a predetermined logic set;

a segment modification matrix table for selecting a logic operation from the predetermined logic set for modifying the samples;

a first register for storing a column select address of the segment modification matrix table, wherein the segment modification matrix table comprises a predetermined number of rows;

a second register for storing a row select address of the segment modification matrix table, wherein a content at a selected column and row of the segment modification matrix table determines the selection of the logic operation, wherein the segment modification matrix table further comprises a predetermined number of columns; and a shift module for shifting the content of the first register for providing a table address to read a sample of the prototype waveform from the memory table, wherein the predetermined number of rows equals the number of predetermined waveforms required to generate, and the predetermined number of columns equals the number of segments of the prototype waveform partition.

17. The waveform generating system of claim 16 further comprising an accumulator coupled between the shift module output and the memory table input and configured to add the shifted content of the first register with a predetermined offset address for providing the table address.

18. The waveform generating system of claim 17, wherein the predetermined offset address is stored in the segment modification matrix table.

19. The waveform generating system of claim 16 further comprising a digital signal processor (DSP) for writing the address information into the first and second registers, and for reading the modified sample of the prototype waveform.

20. The waveform generating system of claim 19, wherein the DSP reads a predetermined sample of the prototype waveform directly from the memory table through one or more multiplexers without any modification.

21. The method of claim 16, wherein the predetermined logic is selected from the following:

no-change;

negating; and zero-output.

* * * * *